United States Patent [19]

Ebihara et al.

[11] 4,193,255

[45] Mar. 18, 1980

[54] ELECTRONIC TIMEPIECE WITH CALENDAR FUNCTION

[75] Inventors: Heihachiro Ebihara; Fukuo Sekiya, both of Tokorozawa; Takashi Yamada, Sayama, all of Japan

[73] Assignee: Citizen Watch Co., Ltd., Tokyo, Japan

[21] Appl. No.: 925,714

[22] Filed: Jul. 18, 1978

Related U.S. Application Data

[63] Continuation-in-part of Ser. No. 756,677, Jan. 4, 1977, abandoned.

[30] Foreign Application Priority Data

Jan. 12, 1976 [JP] Japan ..... 51-2614
Jun. 1, 1976 [JP] Japan ..... 51-63830

[51] Int. Cl.[2] ..... G04B 19/24
[52] U.S. Cl. ..... 368/34; 364/715; 235/92 T; 368/251; 368/111
[58] Field of Search ..... 235/92 T, 92 CA, 92 PE; 58/4 A, 23 R, 39.5, 152 B, 85.5, 22.9, 152 R, 38; 40/107; 364/715

[56] References Cited

U.S. PATENT DOCUMENTS

| | | | |
|---|---|---|---|
| 3,664,117 | 5/1972 | McIntosh | 235/92 T X |
| 3,877,216 | 4/1975 | Mounce et al. | 235/92 PE X |
| 3,916,172 | 10/1975 | Engle, Jr. | 235/92 PE |
| 3,980,868 | 9/1976 | Thompson | 235/92 PE X |
| 4,005,571 | 2/1977 | Wolff | 58/152 B X |

*Primary Examiner*—Ulysses Weldon
*Attorney, Agent, or Firm*—Frank J. Jordan

[57] ABSTRACT

An electronic timepiece comprising a counter circuit adapted to present reference data indicative of an existing year, month, date and day of the week, and operative to count leap years, years, months, dates, and days of the week at a high speed with a preset reference data as a starting point, a register for storing calendar data indicative of a desired year, month, date and day of the week to be determined, a comparator for comparing the content of the counter circuit and the content of the register and generating a coincidence signal when the contents are in agreement, and a controller for halting counting operation of the counter circuit in response to the coincidence signal to cause a display device to display the contents of the counter circuit to obtain an indefinite item concerning calendar.

15 Claims, 19 Drawing Figures

(a)

(b)

(c)

(d)

(a)

(b)

(c)

(d)

ELECTRONIC TIMEPIECE WITH CALENDAR FUNCTION

This application is a continuation in part of patent application Ser. No. 756,677, filed Jan. 4, 1977 and now abandoned.

This invention relates to electronic timepieces and, more particularly, to an electronic timepiece having a calendar function.

Conventional electronic timepieces usually employ an oscillator circuit to provide a relatively high frequency signal, a frequency divider to divide down the relatively high frequency signal to provide a low frequency signal as a time unit signal, a time counter responsive to the time unit signal to provide various time data such as seconds, minutes and hours, which are displayed by an electro-optical display device. In order to provide calendar data, the electronic timepieces also include a dates counter, a days of week counter, a months counter, and a years counter. In the electronic timepieces of this type, it is frequently desired that an indefinite item of information concerning a calendar be obtained. However, it is impossible for the conventional electronic timepieces to accurately and rapidly detect and display the indefinite item of calendar information.

It is, therefore, an object of the present invention to provide an electronic timepiece equipped with a calendar function which, through a simple operation, makes it possible to accurately and rapidly detect and display an indefinite item of information concerning a calendar.

It is another object of the present invention to provide an electronic timepiece arranged to calculate and display an indefinite past or future calendar date through a simple operation.

It is still another object of the present invention to provide an electronic timepiece having a calendar function which is simple in construction and highly reliable in operation.

Figure 1:
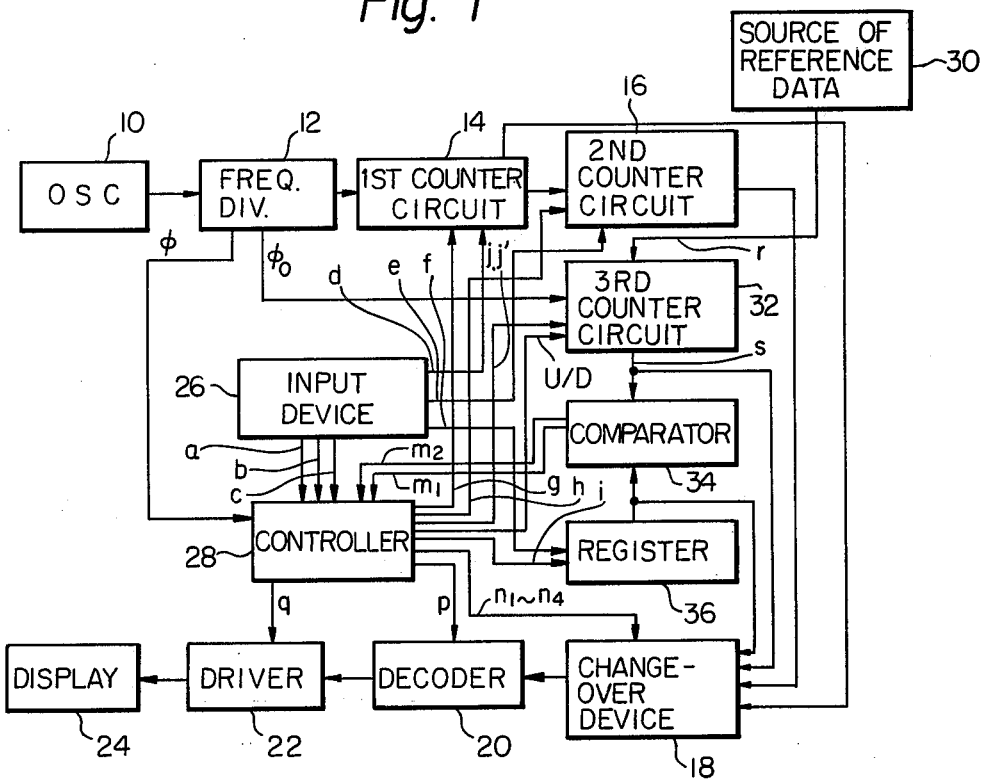
FIG. 1 is a block diagram of a preferred embodiment of an electronic timepiece according to the present invention.
Figure 3:
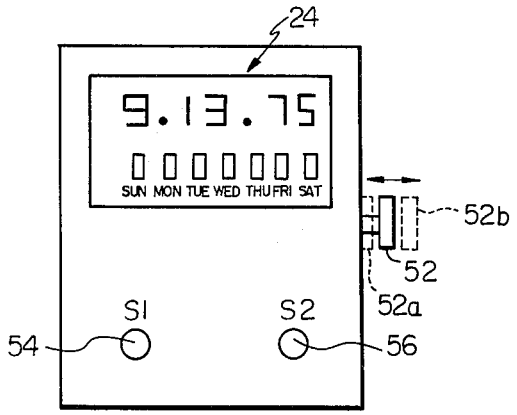
FIG. 3 is a schematic view of an outer appearance of an electronic timepiece incorporating the circuit shown in FIGS. 1 and 2.
Figure 4:
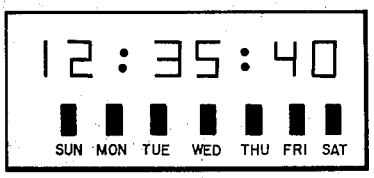
Figure 4:
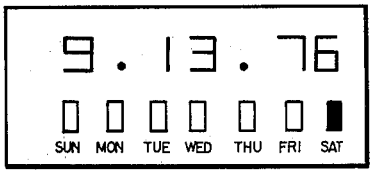
Figure 4:
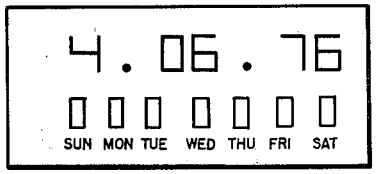
Figure 4:
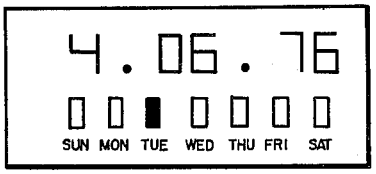
Figure 5:
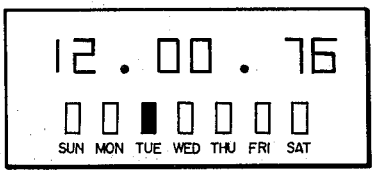
Figure 5:
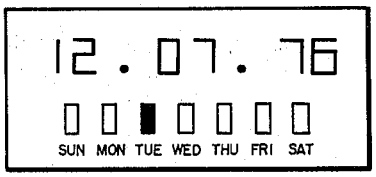
Figure 5:
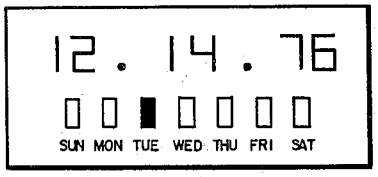
Figure 5:
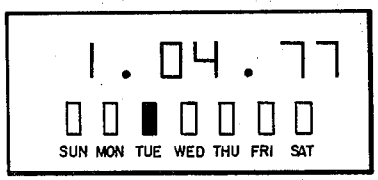
Figure 6:
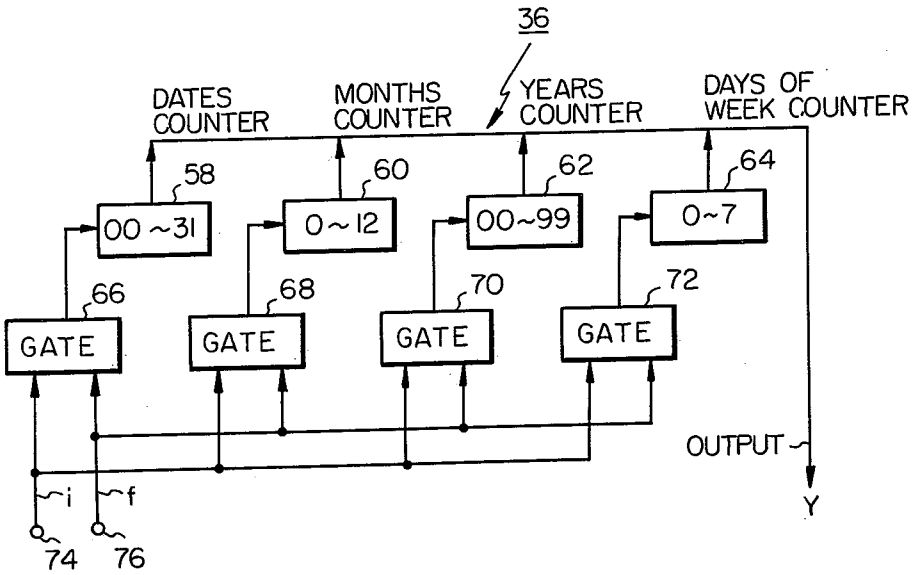
Figure 7:
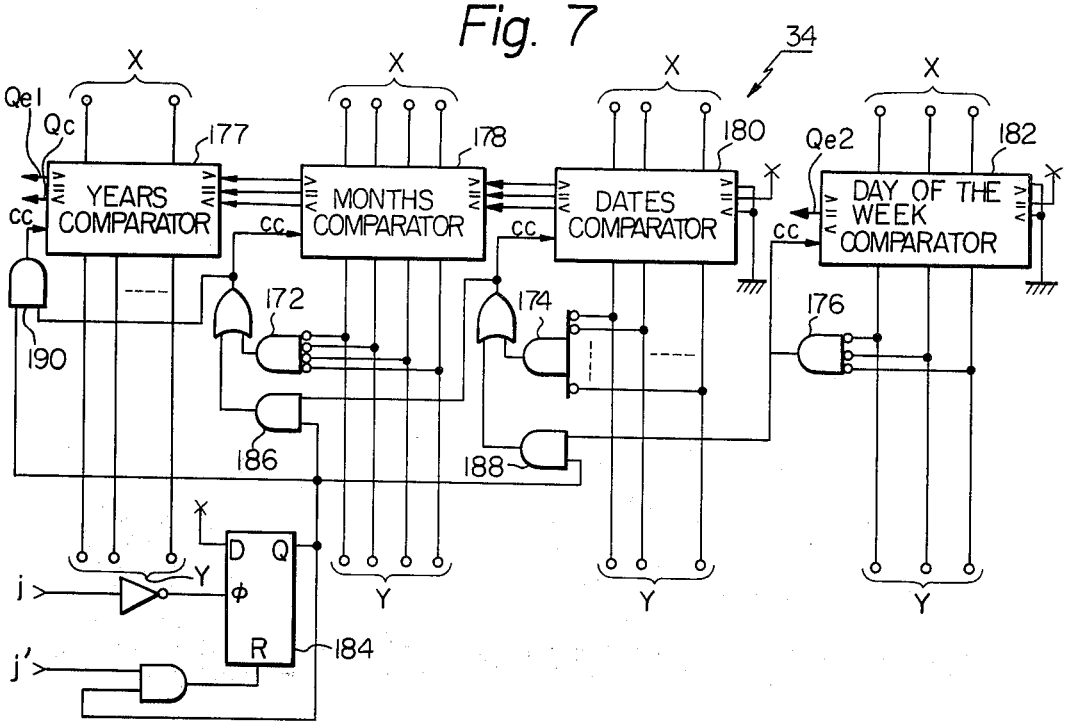
Figure 8:
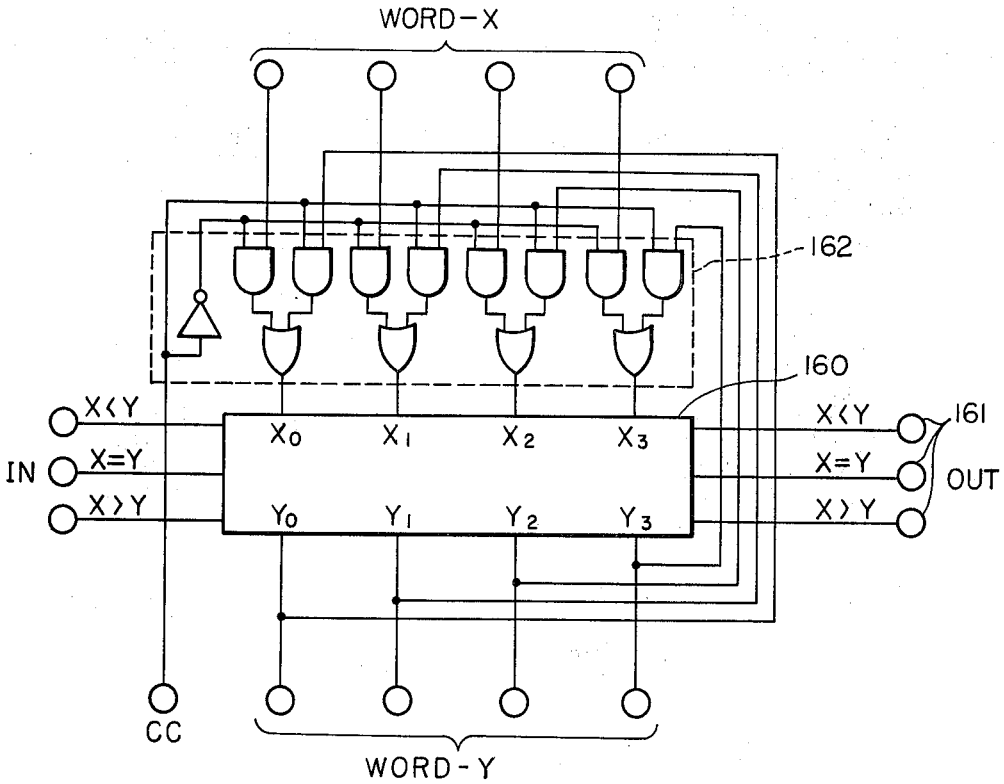
Figure 9:
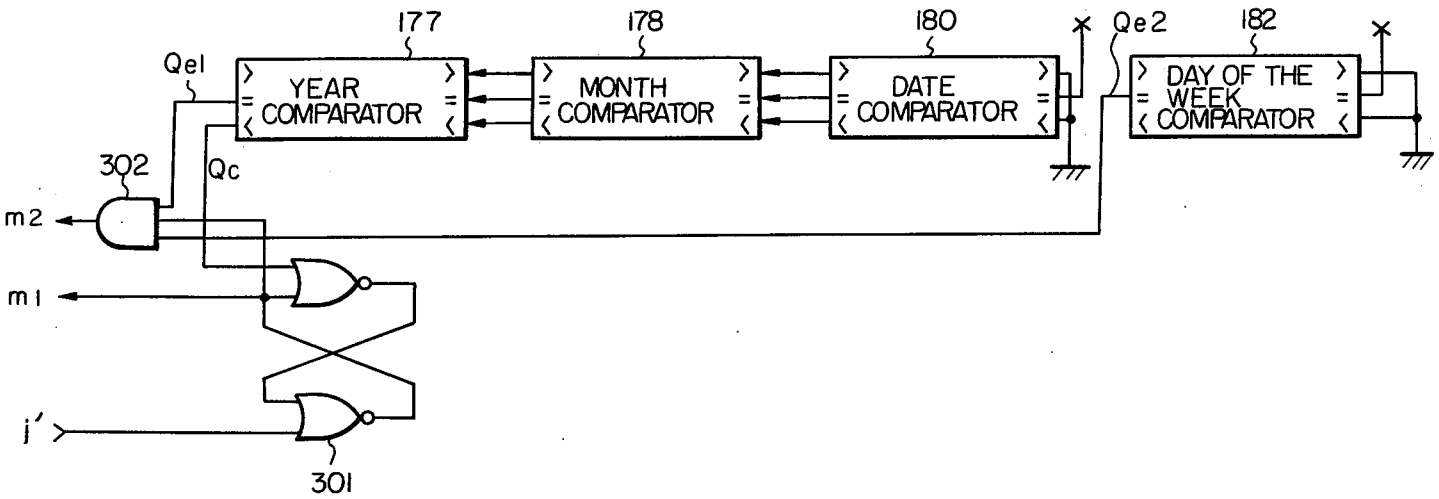
Figure 10:
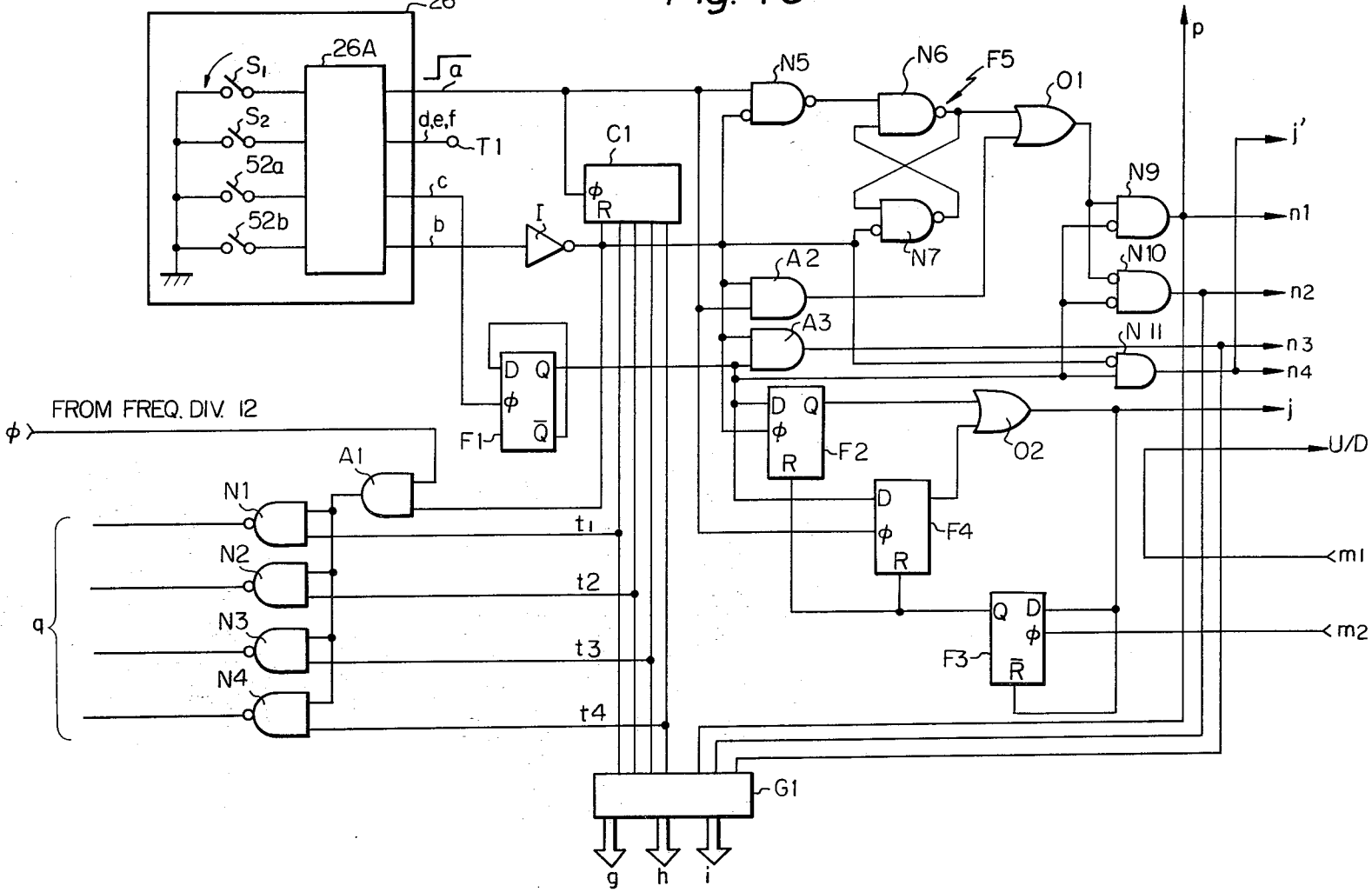
Figure 11:
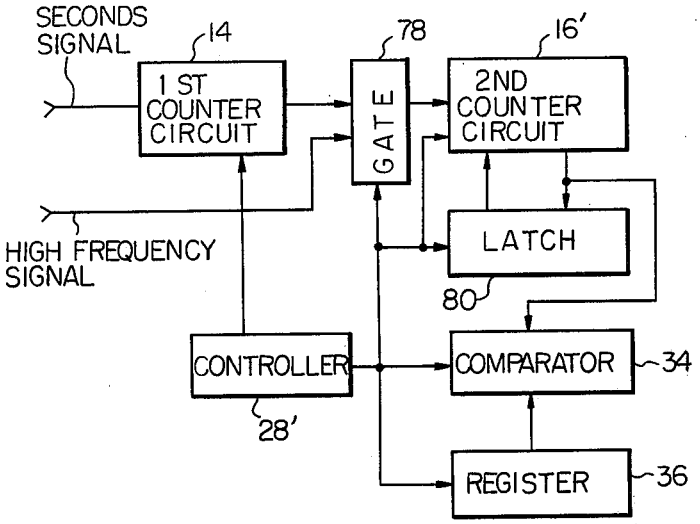
Figure 13:
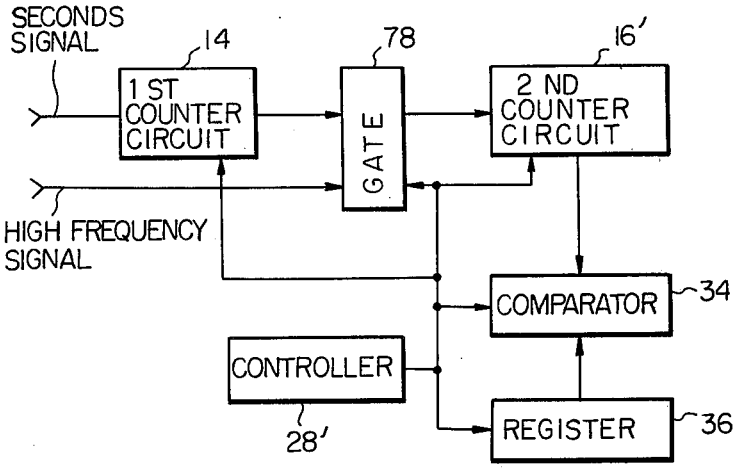
Figure 12:
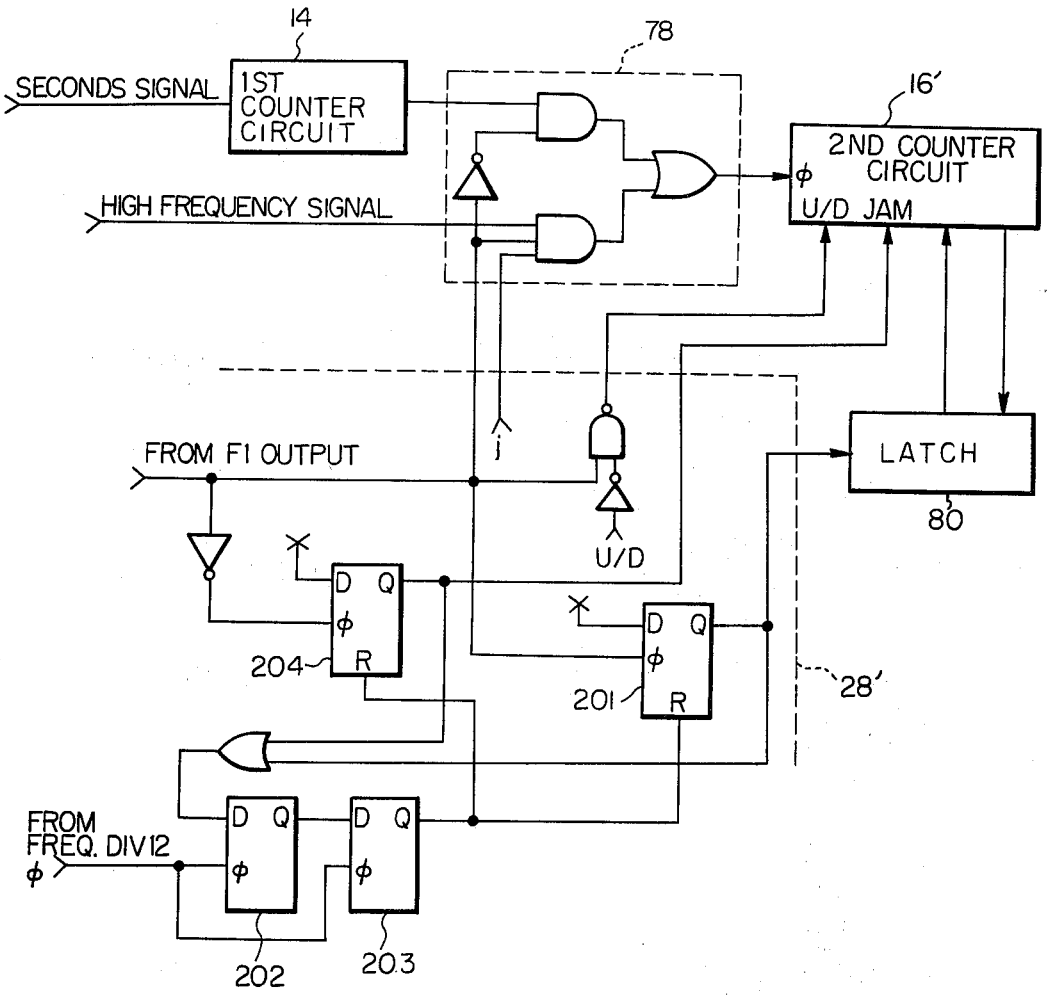
Figure 15:
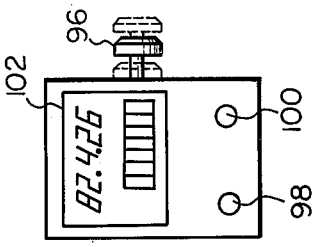
Figure 14:
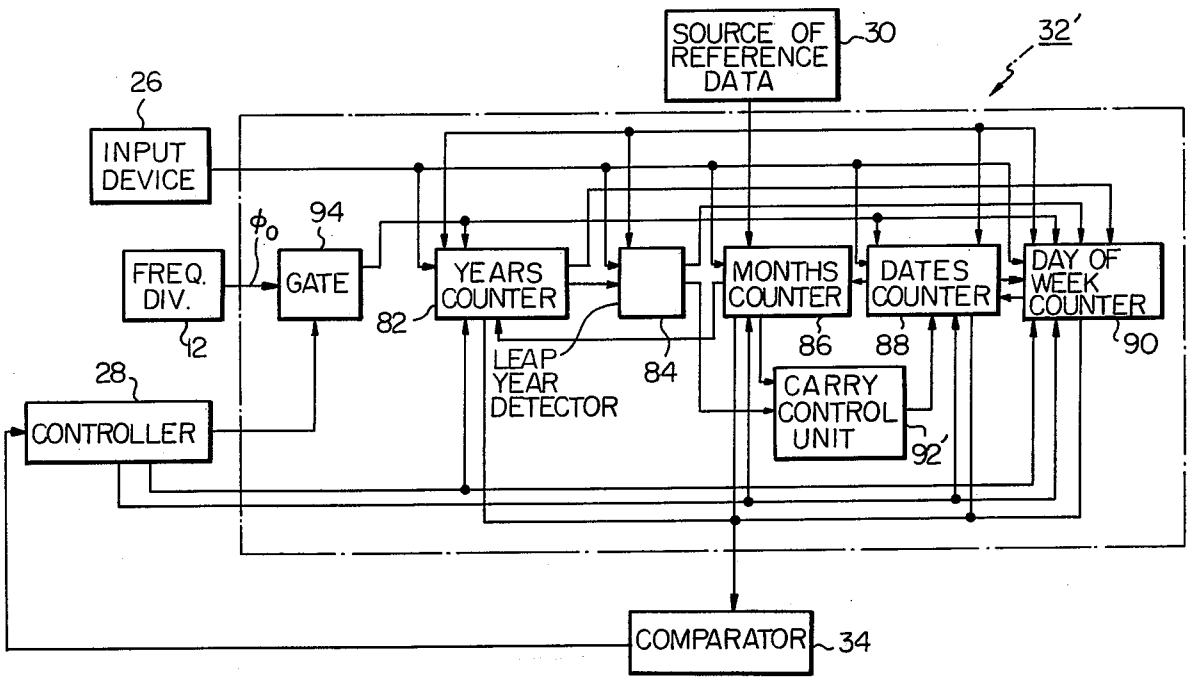
Figure 16:
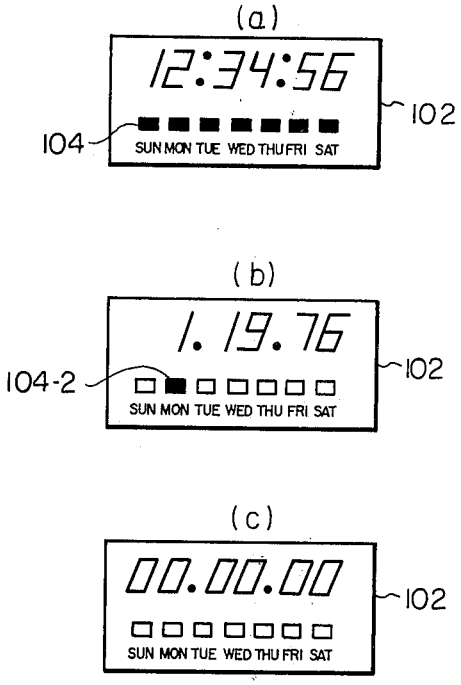
Figure 17:
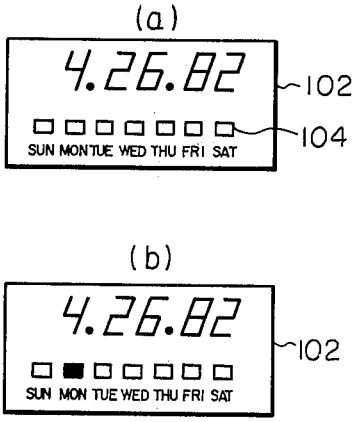
Figure 18:
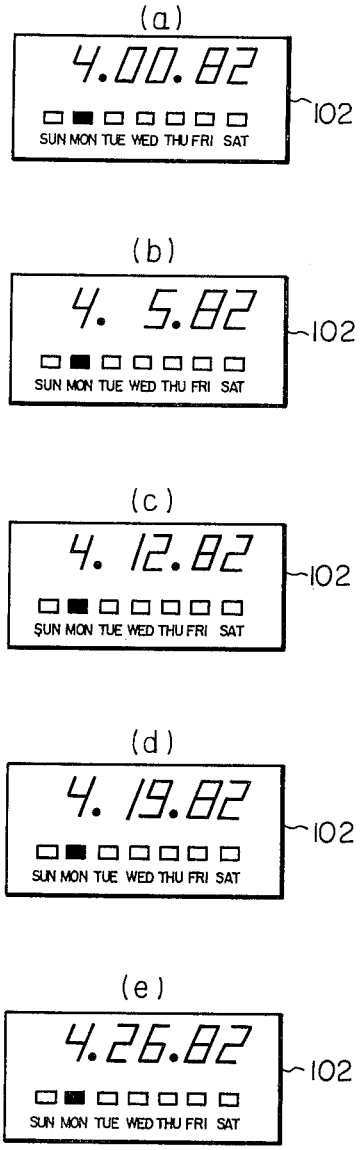
Figure 19:
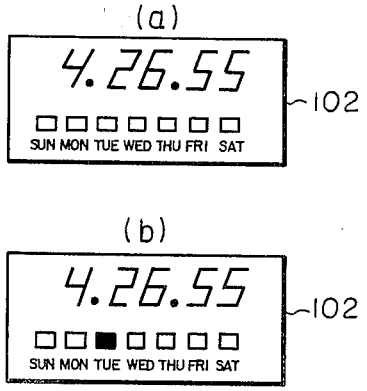

FIGS. 4(*a*) to (*d*) are schematic views illustrating the operating states of the electronic timepiece shown in FIG. 3;

FIGS. 5(*a*) to (*d*) represents other operating states of the timepiece;

FIG. 6 is a block diagram showing a register forming part of the timepiece shown in FIG. 1;

FIG. 7 is a block diagram showing an example of a comparator shown in FIG. 1;

FIG. 8 is an example of a detail circuitry for a portion of the comparator shown in FIG. 7;

FIG. 9 is a part of the comparator shown in FIG. 7;

FIG. 10 is a circuit diagram of a preferred example of the controller shown in FIG. 1;

FIG. 11 is a block diagram of a modified form of the timepiece shown in FIG. 1;

FIG. 12 is a detailed circuitry for the timepiece shown in FIG. 11;

FIG. 13 is a block diagram of another modified form of the timepiece shown in FIG. 1;

FIG. 14 is a block diagram of another preferred embodiment of an electronic timepiece according to the present invention;

FIG. 15 is a schematic view of an electronic timepiece according to the present invention;

FIGS. 16(*a*) to (*c*) show one example of operational states of the timepiece shown in FIG. 15;

FIGS. 17(*a*) and (*b*) show another example of the operational states;

FIGS. 18(*a*) to (*e*) show still another example of the operational states; and FIGS. 19(*a*) and (*b*) show a further example of the operational states.

Referring now to FIG. 1, there is shown a block diagram of one preferred embodiment of an electronic timepiece according to the present invention. The electronic timepiece comprise an oscillator circuit 10 controlled by a quartz crystal to provide a relatively high frequency signal, which is applied to a frequency divider 12. The frequency divider 12 is arranged to divide down the relatively high frequency signal to produce a 1 Hz output pulse train as a 1-second signal, which is applied to a first counter circuit 14. The first counter circuit 14 comprises a seconds counter, a minutes counter, and an hours counter, though not shown, to produce various time data. The seconds counter divides the 1-second signal into a one-minute signal, counting 60 seconds. The minutes counter divides the one-minute signal into a 1-hour signal, which is divided down by the hours counter to produce a 1-day signal whenever 12:00 o'clock midnight is detected. The 1-day signal is applied to a second counter circuit 16 preferably composed of a dates counter, a days of week counter and a months counter to produce various calendar data. The second counter circuit 16 further comprise a years counter and a leap years counter. The outputs from the first and second counter circuits 14 and 16 are applied through a change-over device 18 to a decoder 20, which provides display information signals. These signals are applied to a driver circuit 22, which generates drive signals to drive a display device 24 to indicate time or calendar information.

In accordance with an important feature of the present invention, the electronic timepiece further comprises an input device 26, a controller 28, a source 30 of reference data, a third counter circuit 32, a comparator 34, and a register or memory circuit 36, all of which are normally maintained in their inoperative conditions and rendered operative when they are energized in a manner as will be described in detail hereinafter. The input device 26 may be of any known types such as a push-button switch or a crown insofar as it generates mode signals on leads a, b and c representing a time correction mode, a calendar correction mode and a calendar function mode, respectively. The input device 26 also generates a time correction signal, a calendar correction signal and a calendar setting signal on leads d, e and f, respectively, during the time correction mode, the calendar correction mode and the calendar function mode, respectively. Thus, the correction signals can be input to the first and second counter circuits 14 and 16, respectively, and desired calendar data to be determined can be input to the register 36 via the lead f by actuation of the input device 26 when the register 36 is rendered operative by the controller 28.

The controller 28 responds to the mode signals on leads a, b and c for thereby generating control signals on leads g, h and i coupled to the first counter circuit 14, the second counter circuit 16 and the register 16, respectively, which are consequently rendered operative to receive output signals from the input device 26 via the leads d, e and f. When the calendar function mode signal is applied via the lead c to the controller 28, it generates a preset enable signal which is applied to the third counter circuit 32 via lead j, through which a count enable signal generated by the controller 28 is also applied to the counter circuit 32. This counter circuit 32 receives reference data from the source 30 which are preset in the third counter circuit 32 in response to the preset signal applied thereto via the leads j. The third counter circuit 32 responds to the count enable signal and starts the counting operation at a high speed in response to the high frequency signal $\phi o$. The reference data include calendar information relating to an actual or existing year, month, date, and day of the week, 12.5.75, by way of example. Any data will suffice as long as it exists; thus if the content of the second counter circuit is correct, this may be used as the reference data. The output from the third counter circuit 32 is applied to the comparator 34, to which the stored data are also applied from the register 36. Thus, the content of the third counter circuit 32 is compared to the content of the register 36 by means of the comparator 34, and when both contents coincide a coincidence signal *m2* is generated by the comparator 34. This coincidence signal is applied via a lead *m2* to the controller 28. At this instant, the controller 28 stops to supply the count enable signal via the lead j to the third counter circuit 32, the counting operation of which is consequently stopped. Thereafter, the controller 28 generates a switching signal which is applied to the change-over device 18 via lead n. Since, in this case, the change-over device is shifted to a calendar display mode from its normal display mode so that the output of the third counter circuit 32 is applied through the change-over device 18 to the decoder 20. The decoder 20 applies decoded signals to the driver circuit 22, which generates a drive signal to indicate the content of the third counter circuit 32 to provide information relating to the desired calendar data.

The decoder 20 includes a days decoder circuit (not shown), which may be energized to decode the days of the week in response to an output signal applied from the controller 28 via a lead p. Indicated as q is a lead through which a flashing signal is applied from the controller 28 to the driver circuit 22 to cause the display to flash on and off to indicate the digit to be corrected.

Figure 2:
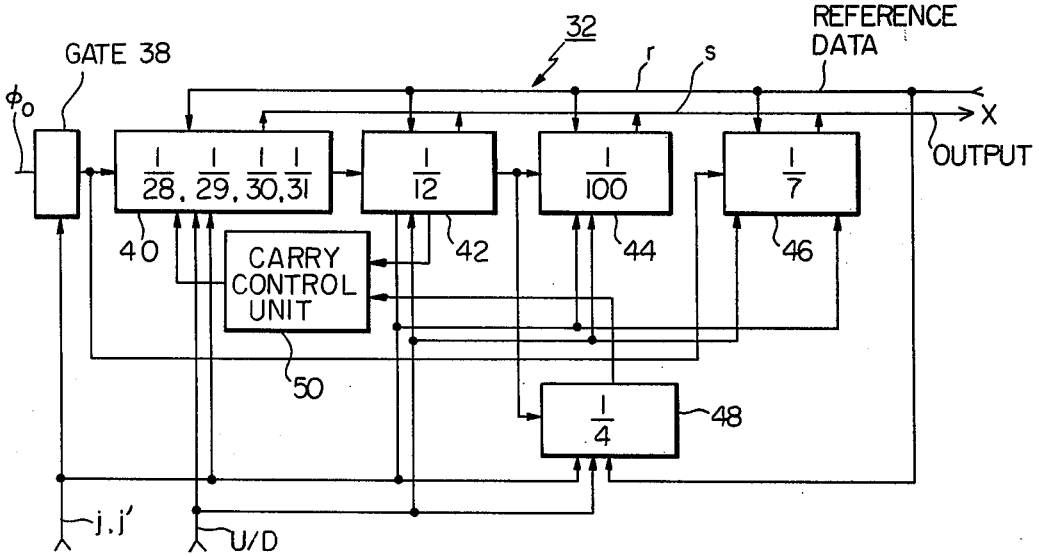
FIG. 2 is a detail block diagram of a part of the circuit shown in FIG. 1.

FIG. 2 shows a block diagram of the third counter circuit 32. As shown, the third counter circuit 32 includes a gate 38 having its input terminal connected to the intermediate stage of the frequency divider 12 and its control terminal connected to the controller 28 via the lead j which is also connected to control terminals of a dates counter 40, a months counter 42, a years counter 44, a days of the week counter 46 and a leap year counter 48. An output of the gate 38 is connected to inputs of the dates counter 40 and the days of the week counter 46. When the gage 38 is opened in response to the count enable signal from the controller 28, the high frequency signal is passed to inputs of the dates counter 40 and the days of the week counter 46. The dates counter 40 consequently commences to count the pulses of the high frequency signal. Thus, the dates counter 40 provides a 1-month signal, i.e. a count of 28, 29, 30 or 31 depending upon a carry control signal generated by a carry control unit 50 responsive to outputs of the month counter 42 and the leap year counter 48. At the same time, the days of the week counter 46 provides a 1-week signal, i.e. a count of 7. The 1-month signal is applied to the months counter 42, which provides a 1-year signal, i.e. a count of 12. The 1-year signal is applied to inputs of the years counter 44 and the leap year counter 48. The years counter 44 provides an output signal, i.e. a count of 100. The leap years counter 48 provides a leap year signal, i.e. a count of 4, to the carry control unit 50. The outputs of each counter of the third counter circuit 32 are applied via a lead s to the comparator 34 as previously noted. The counters 40 to 48 have preset terminals, respectively, connected via a lead r to the source 30 of reference data, which are preset in the counters 40 to 48 in response to the control signal applied thereto via the lead j.

FIG. 3 shows a schematic view of an electronic timepiece incorporating the electric circuitry shown in FIGS. 1 and 2. The timepiece shown in FIG. 3 has a crown 52 which is capable of either being depressed or pulled out one step from its normal position as shown by arrows. The timepiece is also equipped with push-button switches 54 and 56 which form part of the input device 26 together with the crown 52.

The operation of the timepiece will now be described with reference to FIGS. 4(*a*) to 4(*d*).

FIG. 4(*a*) shows the normal state of display in which the digits indicate a time of 12:35:40. Here, the stations for displaying the days of the week are all illuminated which is indicative of a PM situation. If the switch S1 is depressed, the content of the second counter circuit 16 is displayed during this interval, as shown in FIG. 4(*b*). The display represents a calendar date of Sept. 13, 1976 (9.13.76).

In FIG. 4(*a*), pulling out the crown 52 brings the timepiece into a time correction state and extinguishes the digits by their flashing on and off. Depressing the switch S1 brings about a successive change in each of the digit stations and permits any particular station to be selected. Depressing the switch S2 effects a successive correction in the digits for the particular selected station and enables the station to be set to a desired digit. If the switch S1 is depressed to enable the state of FIG. 4(*b*) and the crown 52 is pulled out while the switch S1 is depressed, the timepiece is brought into the state for a year, month, date and day of the week correction; thus, the year, month, date and day of the week (represented by stations instead of digits) can be set by manipulating S1 and S2 as was the case for setting the time. Returning the crown 52 to its normal position removes the correction state and returns the timepiece to the display as shown by FIG. 4(*a*).

The crown 52 is constructed to act as a push-button switch and alternately changes over between the time display mode and function mode each time it is depressed. When the calendar function mode is chosen the display station displays the content of the register 36 and the reference data is preset by the third counter circuit 32. When the crown 52 is pulled out, the register 36 is brought to the write-in state and the desired year, month, date and day of the week are applied as an input by the same method used to perform the afore-mentioned time correction. In this case a 0 or 00 is applied as an input to the station which will display the particular piece of information which is sought. In other words, if it is desired to know what day of the week Apr. 6, 1976 represents, the years station of the register 36 is set to 76, the months station to 04, the date station to 06, and the day of the week station to 0 (whereby all of the display stations for the days of the week are extinguished.). If it is desired to know what the date will be on the first Sunday of April, 1976, the years station is set to 76, the months station to 04, the date station to 00, and the day of the week station to 1. Similarly, the months station is set to 00 when it is desired to know what month begins on a Sunday. It should be noted that a 00 in the years counter of the register 36 is not the data to be detected and indicates, for example, a year of 1900.

The register 36 is constructed as shown in FIG. 6 and comprises a dates counter 58 capable of counting from 00 to 31, a months counter 60 capable of counting from 0 to 12, a years counter 62 capable of counting from 00 to 99, a days of the week counter 64 capable of counting from 0 to 7, and gates 66, 68, 70 and 72 which are selectively open and closed in response to a control signal i applied to a control terminal 74. Gates 66, 68, 70 and 72 are also provided with input signals f applied to an input terminal 76 from the input device 26 in response to manipulation of the switch S1 in order to advance each of the counters.

The countable range for each of the counters of the third counter 32 is 01–31 for the dates counter, 01–12 for the months counter, 1–7 for the days of the week counter, and 00–99 for the years counter. Accordingly, with the exception of information relating to the year there is no agreement between the third counter circuit 32 and the register 36 with regard to the 0 and 00 information to which the register 36 has been set. However, in this illustrated embodiment, a description will be given as if the data 00 set in the dates counter 58 or the months counter 60 and the data 0 set in the days of the week counter 64 are in agreement with the content of the third counter circuit 32 for a reason as will be clarified.

FIG. 4(*c*) shows the state of the display in which the register 36 is input with the information Apr. 6, 1976, as described above, with the days of the week station set to 0. When the crown 52 is returned to the normal position, the comparator 34 first makes a comparison between the relative size of the year, month and date content of the third counter circuit 32 and the register 36 and feeds the result to the controller 28 via the lead m1 or m2. If the content of the counter circuit 32 is the same as or larger than the content of register 36, a U/D signal produced by the controller 28 goes to a low level to cause the counter circuit 32 to count down at a high speed so as to reduce its content to below that of the register 36, in a manner as will be described later. If the content of counter circuit 32 becomes smaller than that of the register 36, the U/D signal goes to a high level to upcount the counter circuit 32 until the content of the counter circuit 32 is brought into agreement with the content of the register 36. When this has been achieved, the count enable signal j goes to a low level and the gate 38 is closed. The counter circuit 32 ceases counting operation and the display is switched at the same time; i.e., the display is switched from the content of the register 36 to the content of the third counter circuit 32. Since the counter circuit 32 has been correctly counting the years, months, date and days of the week based upon the reference data, Tuesday is correctly displayed as the day of the week, as shown in FIG. 4(*d*), even with respect to the day of the week set to 0 in the register 36.

According to a feature of the invention, once the counter circuit 32 has been put into the counting state and then ceases counting, the controller 28 operates and changes the state of the comparator 34. In other words, when the register 36 is set such that there is a 0 in the days of the week counter 64 as well as a 00 in the date counter 58, the date, month and year in subsequent comparisons are disregarded and considered to be in agreement at all times in a manner as will be subsequently described. Also, when the content 00 is set in the months counter 60, the year in the subsequent comparison is disregarded and considered to be in agreement at all times. The counting operation of counter circuit 32 which has halted can be continued by depressing the switch S1. Thus when the first signal indicative of a resumption in the count arrives, the aforementioned content of the counter circuit 32, namely Tuesday, Apr. 6, 1976 (4.06.76 Tues.) becomes Wednesday, Apr. 7, 1976 (4.07.76 Wed). However, since the day of the week counter 64 of the register 36 was originally set to 0, and all other comparisons are deemed to be in agreement, the count once again ceases. If the switch S1 is depressed again, the date will become 4.08.76 Thurs. The calendar advances successively in this manner.

FIG. 5 shows a different example for a case in which the date is sought for Tuesdays in the month of December, 1976. Thus, the dates counter 58 of the register 36 is set to 00, and FIG. 5(*a*) shows the state of the display for an input of Tuesday, December, 1976 (12.00.76 Tues). When the crown 52 is returned to its normal position, the counter circuit 32 begins to count at a high speed as was the case with the previous example, and stops counting at the first Tuesday of December, 1976. The content of the counter circuit is thus displayed as Tuesday, Dec. 7, 1976 (12.07.76. Tues.) as can be seen in FIG. 5(*b*). All subsequent comparisons with regard to date, month and year are disregarded. Accordingly, when counting is resumed by depressing the switch S1, the next Tuesday of the month, namely Tuesday, Dec. 14, 1976 (12.14.76 Tues) appears and counting stops. If the display is continuously advanced in the same manner, it is possible to advance the display to the following year, as shown in FIG. 5(*d*). The timepiece can be returned from the calendar function to the timekeeping function by depressing the crown 52.

The present embodiment as depicted in FIG. 1 is equipped with a fixed reference data source 30. Although this data source is sufficient for displaying the actual year, month, date and day of the week, it is not possible to set it with respect to digits indicative of 100 years or more since the counting process makes use of two digits only. Accordingly, it is necessary to take it for granted that the digits indicative of 100 years or more as called forth by the calendar function are the same as those digits in the reference data supply indicative of 100 years or more. To state it more practically, "76", the filing date of this application, is actually 1976, and "00" is 1900. Thus the reference data must in the same way represent the years, months, date and days of the week which actually exist in the 1900's. It is evident that in the case of fixed reference data a correct calendar function will no longer be capable of execution when the number of digits changes form two to three, as will be the situation for 100 years or more. It is therefore desirable that the reference data be capable of being set.

On the assumption that the content of the second counter circuit 16 is correctly set, the abovementioned problem can be resolved by employing this information as the reference data. In particular, if a reference data register with a write-in capability is provided and this register is set to data of 01.01.00, it should be appreciated from the foregoing explanation that, since the value of the register 36 is greater than this value, there is no need for the execution of a down count and that only an upcount will suffice.

FIG. 7 shows an example of the comparator 34 shown in FIG. 1. The comparator 34 is shown as comprising a years comparator 177, a months comparator 178, a dates comparator 180, and a days of week comparator 182. Each of the comparators may comprise a component "CD 4063B" manufactured by RCA Corp., in U.S.A. an example of which component is shown in FIG. 8, and AND/OR gate 162 composed of an inverter 162*a* and gates known as "CD 4019A" elements manufactured by RCA Corp. When control terminal cc is at a low potential, a WORD-X is impressed upon the X-WORD input terminals of comparator 160 and the result of a comparison with the WORD-Y appears at the output terminals 161. When a high potential is impressed upon the terminal cc, the data at the corresponding Y-WORD input terminals is applied to the X-WORD input terminals of comparator 160; hence, the results of the comparison are treated as being equal at least in relation to the 4 bits shown in FIG. 8.

Turning now to FIG. 7, when the month, date and day of the week positions have been set to 00 or 0, gates 172, 174, 176,190 produce high potential output signals which are coupled to the control terminals cc of the corresponding comparators 178, 180, 182,177, thus establishing the state for disregarding the results of a comparison. A flip-flop 184 is triggered by the falling edge portion of a count enable signal j and is reset by a preset enable signal j. Accordingly, the output of flip-flop 184 attains a high potential level when counter 32 begins to count once and is caused to stop counting for the first time. This signal is coupled to gates 186, 188, 190. As a result, when the day of the week or date positions in register 36 have been set to 0 or 00, respectively, a subsequent comparison of date, month and year is disregarded and, if the months position has been set to 00, a year comparison is disregarded.

As described above, the date, and what the date will be, of a specific day of the week in a specific year and month can be known. As a specific example, it has been previously stated what the date will be on a Tuesday in December, 1976. The expected responses are Dec. 7, 14, 21, 28 . . . By way of example, let the calculation be carried out on the basis of Dec. 28, 1976. The data established in register 36 is indicative of the year 1976, December, a date 00, and the day of the week Tuesday. The present invention covers a case in which the content of counter 16 is used in place of a standard data source so that, in the present case, Tuesday, Dec. 28, 1976 is preset in counter 32. The comparator 34 therefore will issue a coincidence signal. Only a response indicative of a date after December 28 will be obtained if counter 32 counts up and not down, thus giving a result with no practical application. Accordingly, in the present invention, when the content of counter 32 is greater than the content of register 36, the counter 32 is caused to count down once and the result of a comparison is made to become a negative value. In the foregoing example, the content of counter 32 becomes Tuesday, Nov. 30, 1976 and the count changes over from a down-count to a upcount for the first time, establishing data indicative of Tuesday, Dec. 7, 1976, after which the count ceases.

A specific example of a circuit designed to provide this operation is shown in FIG. 9. Since the structure of a circuit adapted to disregard the result of a comparison has already been described with reference to FIG. 7, this portion has been omitted from the drawing of FIG. 9. A preset enable signal j is at a high potential level when data is being input to the register 36; accordingly, the output terminal of gate 301 is at a low potential. The output Qc of the comparator 177 is at a high potential when the content of counter 32 is smaller than the content of register 36. Now, when preset enable signal j' changes from a high potential to a low potential, and if the output Qc is assumed to be at the high potential, the output m1 of gate 301 attains a high potential which causes counter 32 to perform an up-count.

Upon coincidence of the count, Qc attains a low potential and coincidence detection gate 302 provides a coincidence signal m2 without the output of gate 301 changing. Counter 32 thus stops counting. The subsequent count is an up-count only.

Next, it will be assumed that output Qc is at a low potential when the preset enable signal j' changes from the high to a low potential. In this instance, the output m1 of gate 301 remains at a low potential and counter 32 is caused to count down. Even if coincidence is detected in the comparator during the count-down operation, no coincidence signal m2 appears since the output of gate 301 is at a low potential. Counter 32 therefore continues counting down and eventually the data in the counter 32 becomes smaller than that in the register 36. At such time Qc attains a high potential as does the output of gate 301. The counter 32 thus resumes the up-count and the foregoing operation is restored.

FIG. 10 shows a circuit diagram of a preferred example of the controller 28 shown in FIG. 1, in which like or corresponding parts are designated by the same reference numerals and symbols as those used in FIG. 1 to 9. As shown, the controller 28 is connected to the input device 26, which is seen to include switches S1 and S2 corresponding to those shown in FIG. 3, and switches 52*a* and 52*b* which are closed when the crown 52 is depressed and pulled out, respectively, as shown in FIG. 3. The input device 26 also includes a circuit 26A for preventing the input device 26 from being adversely affected by chattering of the switches. Outputs a, and d, e and f of the input device 26 go to a high logic level when the corresponding switches S1 and S2 are closed. The output a is connected to a clock input terminal of a counter C1, one input terminal of a NAND gate N5, one input terminal of an AND gate A2, and a clock input terminal of a flip-flop F4. The outputs d, e, f are connected to a terminal T1, from which outputs are applied to update the counts in the first counter circuit 14, the second counter circuit 16 and the register 36 as shown in FIG. 1. The output b is connected to a clock input terminal of a flip-flop F1, whose output Q is connected to one input terminal of an AND gate A3, one input terminal of a NAND gate N11, data input terminals of flip-flops F2 and F4. The output C is connected to an input of an inverter I, the output of which is connected to one input terminal of an AND gate A1, the remaining input terminals of the NAND gate N5, AND gate A2 and AND gate A3, and a clock terminal of the flip-flop F2. The output of the inverter I is also connected to a reset terminal of the counter C1, whose outputs t1 to t4 are connected to input terminals of NAND gates N1 to N4, to the other input terminals of which are also applied an output of the AND gate A1.

The AND gate A1 has its remaining input terminal connected to the frequency divider 12 to receive a higher frequency signal therefrom as a flashing control signal. The outputs t1 to t4 are also applied to a gate circuit G1, to which outputs of the AND gates N9 to N11 are also applied. The output of the inverter I is also connected to one input of a flip-flop composed of NAND gates N6 and N7, to the other input of which is applied an output of the NAND gate N5. An output of the flip-flop F5 is connected to one input terminal of an OR gate O1, whose another input terminal is connected to an output of the AND gate A2. An output of the OR gate O1 is connected to the remaining input terminals of the AND gates N9 to N11. Outputs of the flip-flops F2 and F4 are connected to inputs of an OR gate O2, whose output is connected to a data input terminal of the flip-flop F3. The flip-flop F3 has its clock terminal connected to the comparator 34 through the lead m2 to receive a coincidence signal therefrom to stop the counting operation of the third counter circuit 32 as will be described below. The Q output of the flip-flop F3 is connected to reset terminals of the flip-flops F2 and F4. The controller 28 also receives an up/down control signal U/D from the comparator 34 through lead m1 and applies it to the third counter circuit 32 as an up/-down control signal via lead U/D.

In normal operating mode of the timepiece, all of the switches are maintained in their open state and the outputs a to f are at a low logic level. Under these circumstances, the AND gate N10 generates an output n2 which is applied to the change-over device 18 shown in FIG. 1. The changeover device 18 responds to this output n2 and functions to pass the output of the first counter circuit 14 therethrough to the decoder 20 for thereby causing the display device 24 to display time data such as seconds, minutes and hours.

When it is desired to change over the display to calendar display mode, the switch S1 is depressed. In this case, the output a of the input device 26 goes to a high logic level. At the same time, since the output of the inverter I is at a high logic level, the AND gate A2 is opened to generate an output which is applied through the OR gate O1 to the AND gate N9. Thus, the AND gate N9 generates an output n1 which is applied to the change-over device 18 so that the display mode is changed over to the calendar display mode in which dates, months and years are displayed.

Correction of displayed time can be performed by pulling out the crown 52 thereby to close the switch 52*b*. In this case, the output b of the input device 26 goes to a high logic level and the output of the inverter I goes to a low logic level. Consequently, the reset condition of the counter C1 is released and the AND gate A1 is opened to pass the flashing control signal $\phi$ to the one input terminals of the NAND gates N1 to N4. Under these circumstances, if the switch S1 is depressed in a sequential manner, the outputs t1 to t4 of the counter C1 go to a high logic level in sequential manner, thereby selecting the digit to be corrected or updated. Thus, when the switch 52*b* is closed during the normal time-keeping mode, the output n2 is applied to the gate circuit G1 by which the lead g is selected. Therefore, each of the outputs t1 to t4 generated by the counter C1 is applied through the lead g to the first counter circuit 14 and the digit to be corrected is selected by one of the output signals t1 to t4. If, in this case, the output t1 goes to a high logic level by manipulation of the switch S1, the hours digit is selected and it is updated by applying input signals to the first counter circuit 14 from the input device 26 via the lead d.

In a case where the switch 52*b* is closed during the calendar display mode, the output n1 is applied to the gate circuit G1 by which the lead h is selected. Accordingly, each of the outputs t1 to t4 are applied through the lead h to the second counter circuit 16 to select the digit of the calendar data to be corrected. Thus, when the output t1 goes to a high logic level, the years digit of the calendar data is selected and it is updated by applying input signals to the second counter circuit 16 from the terminal T1 of the input device 26 via the lead e.

The calendar function mode is selected by closing the switch 52*a* upon depression of the crown 52. In this case, the output c goes to a high logic level, and the output of the flip-flop F1 goes to a high logic level. Since, in this instance, the output of the inverter I is at a high logic level, the AND gate A3 generates an output n3, which is applied to the gate circuit G1 to cause the display device to display the content of the register 36. The output n3 is also applied to the gate circuit G1 by which the lead i is selected and each of the outputs t1 to t4 is applied therthrough to the register 36 to write in the desired year, month, date and day of the week in the same manner as in the time correction mode. It should be noted that the year, month, date and day of the week are selected by sequentially manipulating the switch S1 thereby sequentially causing the outputs t1 to t4 to go to a high logic level and the input signals are applied to the register 36 through the lead f upon manipulation of the switch S2. When the switch 52*b* is closed, the output c goes to a high level so that the output of the inverter I goes to a low logic level. Accordingly, the AND gate N11 generates an output n4 which is applied to the change-over device 18 to cause the display device to display the content of the third counter circuit 32. The output of the AND gate N11 is also applied to the third counter circuit 32 as a preset enable signal J'. Thus, the third counter circuit 32 presets the reference data therein in response to the preset enable signal j'. Thereafter, if the switch 52*b* is opened, the output of the inverter I goes to a high logic level so that the output of the flip-flop F2 goes to a high logic level. The output of the flip-flop F2 is applied through the OR gate O2 to the third counter circuit 32 as a count enable signal j by which the gate 38 shown in FIG. 2 is opened to pass the high frequency signal to the counter circuit 32 to permit high speed calculation. At the same time, the up/down control signal generated by the comparator 34 and applied through the lead m1 to the controller 28 is applied as an up/down control signal U/D to the third counter circuit 32. When the content of the third counter circuit 32 is brought into coincidence with the content of the register 36, the comparator 34 generates a coincidence signal which is applied through the lead m2 to the clock terminal of the flip-flop F3. The output of the flip-flop F3 goes to a high logic level, so that the flip-flops F2 and F4 are reset and the count enable signal j is inhibited whereby the counting operation of the third counter circuit 32 is stopped. The flip-flop F4 can be triggered by the manipulation of the switch S1.

Although, in the preferred embodiment described above, the third counter circuit 32 was especially provided to perform a calendar function, the second counter circuit 16 is advanced only at 12:00 o'clock midnight (12:00:00). If there is a guarantee that the advance at this point of time is assuredly performed, the third counter circuit 32 can be omitted and the second counter circuit 16' can perform the calendar function as seen in FIG. 11. In other words, a gate 78 and latch 80 controlled by the controller 28' are provided in place of the third counter circuit 32. At the instant there is a change-over from the timekeeping function to the calendar function, the content of the second counter circuit 16 is temporarily stored in latch 80. Since this content remains as it is in the counter circuit 16', if counting is performed by means of a high speed pulse with this content as reference data, the circuit can operate in a manner similar to the above-mentioned embodiment. At the instant there is a shift from the calendar function to the timekeeping function, the content of the latch 80 is read into the second counter circuit 16', the gate 78 is controlled to pass the output of the first counter circuit 14 to the second counter circuit 16, which is consequently returned to its initial timekeeping state.

FIG. 12 illustrates a more detailed circuitry for the system shown in FIG. 11. Gate 78 functions basically as an AND/OR selection gate. When the output of flip-flop F1 in FIG. 10 is at a low potential, namely during the timekeeping mode, the date signal obtained once per day from counter 14 is passed to the second counter 16 composed of an up/down counter. In addition, a high potential is impressed upon the UP/DOWN signal input terminal of counter 16'. As a consequence of the inputs, counter 16' counts up at a rate of one count per day. The counter 16' may be constructed of RCA "CD 4029A elements or those of a similar type.

If the output of flip-flop F1 is caused to changeover from a low potential to a high potential by manipulating the switch 52*a*, the output of flip-flop 201 attains a high potential so that a latch 80 accepts the data from counter 16. Latch 80 can be constructed of RCA "CD 4042A elements or the like. The high potential at the output terminal of flip-flop 204 is applied to flip-flop 202 in synchronism with clock signal $\phi$ and output Q of flip-flop 202 is applied to flip-flop 203 one cycle later. The output of flip-flop 203 is coupled to the reset terminals of flip-flops 201, 204. Accordingly, after they are triggered the flip-flops 201, 204 are reset after a time interval equal to at least one cycle of the clock signal $\phi$. When the output of flip-flop 201 attains a low potential level, latch 80 latches the data supplied by counter 16'. In this state, the register receives the data necessary for effecting the calendar function, after which count enable signal j reverts from the low to a high potential. As a result, high speed pulses are applied to counter 16' which counts up or counts down responsive to the state of UP/DOWN signal U/D. When signal j changes from a high to a low potential, counter 16' stops counting and has its content correctly displayed by a display device to display the required data.

At the instant that a change-over is made from the calendar mode to the normal timekeeping mode by manipulating the switch 52*a*, the output of flip-flop F1 changes from a high to a low potential, thereby triggering flip-flop 204 the output terminal of which is held at the high potential for at least one cycle of the clock signal $\phi$, as described above. This signal is coupled to the JAM input terminal of counter 16', and the calendar data stored in latch 80 is supplied to counter 16'. More specifically, depending on the calendar mode, the past or future calendar data is rewritten into the present calendar data. Subsequent operation is in the normal timekeeping mode.

A calendar function can still be obtained even if the latch 80 depicted in FIG. 11 is omitted. In this case, if the year, month and date of that particular day are input to the register 36 directly before there is a shift from the calendar to the timekeeping function, thereby causing the calendar to operate, the year, month and date of that day will correctly remain in second counter circuit 16, as previously described; therefore, if the shift is made to the timekeeping function under these conditions, the subsequent timekeeping operation will proceed without hindrance. The relevant circuit is shown in FIG. 13.

It should be understood that those portions of the timepiece not related to the foregoing explanation have been omitted from FIGS. 11 and 13 of the drawings to simplify the illustration.

In the embodiment as described above, the counter circuits are composed of flip-flop circuits and for the sake of convenience the comparison and exchange of data were described as if the bits were processed in parallel. However, it should be noted that it is possible to adopt an arithmetic method using a shift register ring which makes use of an adder-subtractor.

Thus in accordance with the features of the invention, a simple operation provides a calendar display covering a 99 year period and enables a day of the week to be displayed for a specified year, month and date; a date to be displayed for a specified year, month and day of the week; and a month to be displayed for a specified year, date and day of the week. The timepiece of the present invention thus possesses a large number of functions and an extremely wide range of applications. Moreover, for a case in which the register 36 is arranged to set the data to the date counter to a figure such as 41, the aforementioned condition for disregarding the comparison need not always be 0 or 00; it is possible to arrange it so that the comparison is disregarded when data is established which is not representative of an actual date. Further, for a case in which the reference data source is adapted so as to be capable of being set, it is necessary to permit leap-year information to be displayed. For example, if S1 is depressed with the timepiece in the timekeeping mode, it is permissible to arrange for the year, month, date and day of the week to be displayed whereas the leap year information is displayed by depressing S2. When the standard data source is a part of the timekeeping mechanism, or when the counter circuit 32 is associated with the second counter circuit 16, a leap year correction can be automatically performed even if the timepiece is in the timekeeping mode; this means that the calendar function can be disregarded.

FIG. 14 shows a modified form of the third counter circuit 32', with like parts bearing like reference numerals as those used in FIG. 1. In this modification, the third counter circuit 32' is arranged to make it possible to accurately and rapidly detect and display an indefinite item of information concerning a calender, this being accomplished by incrementing or decrementing the year data by one year and day of the week by one day (two days for a leap year) each year during the course of calculations to determine the desired indefinite item. To this end, the third counter circuit 32' comprises a year calculation circuit 82, a leap year detector 84, a month calculation circuit 86, a date calculation circuit 88, a day of the week calculation circuit 90, a carry control unit 92 responsive to signals provided by the leap year detector 84 and the month calculation circuit 86 and operative to control the date calculation circuit 88 to perform a carry operation, and a gate 94 operative to selectively couple the high frequency signal from the frequency divider 12 to the year calculation circuit 92, date calculation circuit 88 and day of the week calculation circuit 90 in response to control signals obtained from the controller 28.

FIG. 15 shows an example of the timepiece incorporating the circuit 32′ of FIG. 14. Switch 96 is a crown capable of being either depressed or pulled out one step from its normal position, and switches 98 and 100 are capable of being depressed. Each time the input switch 96 is depressed there is a change-over in the respective functions of the timepiece enabling a shift to be made to a time display (a), a calendar date display (b) and a display (c) for the calendar function, as shown in FIG. 16. After display (c) for the calendar function is selected, the switch 96 is returned to its normal position. At this time the display shows the content of the register 36 (see FIG. 1), and the reference data from the source 30 is preset in the third counter circuit 32′. For the sake of explanation, it will be assumed that this data is representative of Monday, Dec. 15, 1975, the third year after a leap year. Under these conditions, the switch 96 is pulled out and each of the year, month, date and day of the week counters of the register 36 are successively brought to the read-in state each time the switch 98 is depressed. When the switch 100 is depressed, the numerical value of the item of information selected by the switch 98 undergoes a successive change and this value is applied as a numerical input.

FIG. 17(*a*) shows a case in which the register 36 is input with information representative of Apr. 26, 1982; here the day of the week for this calendar date is desired. As can be seen, the day of the week display stations 104 are all blank since this item of information is indefinite. After the above stated information is applied to the register 36, the switch 96 is returned to its normal position and then the switch 98 is depressed whereby a high speed calculation signal initiates calculations for the calendar function with the reference data as a starting point. The year data "82" of the register 36 and "75" to which the year calculation circuit of the third counter circuit 32′ has been preset are compared in the comparator 34. Since the input data "82" is greater than the reference data "75", the controller 28 applies a control signal to the years calculation circuit 82 and days of the week calculation circuit 90 to perform an adding operation which continues until the comparator generates a years coincidence signal. However, according to the comparator as it is employed in the embodiment of FIG. 14, the years coincidence signal is applied to the controller 28 when the difference between the value as calculated by the year calculation circuit 82 and the year data of the register 36 attains a value of 1. In this case the year calculation circuit 82 is incremented by the high speed calculation signal and the comparator 34 generates the years coincidence signal when the figure "81" is reached. In addition to the year calculation circuit 82, data representative of Monday in the day of the week calculation circuit 90 is also simultaneously incremented by the high speed calculation signal. When the leap year detector 84 detects a leap year during the calculations, the data in the day of the week circuit 90 is further incremented to change this data to Tuesday. With the content of counter circuit 32′ now representative of Tuesday, Dec. 15, 1981, the next set of calculations begin.

The controller 28 in response to the years coincidence signal causes the month calculation circuit 86 to operate and thus a comparison is made between the data "12" in the month calculation circuit 86 and the month data "4" in the register 36. However, since the year calculation stopped at the year "81" which is one year prior to the year data in the register 36, the month calculation circuit 86 is instructed to perform an additing operation. This is accomplished by applying a control signal from the controller 28 to the date and day of the week calculation circuits which are thus simultaneously incremented by the high speed calculation signal until month calculation circuit 86 is brought into agreement with the data in the register 36. After the incremented date calculation circuit 88 in response to the carry control unit 92 has detected either the 31st, 30th, 29th or 28th day of the month, the month calculation circuit 86 performs a carry operation when the following day is the 1st day of the month, and the year calculation circuit 82 performs a carry operation when the month calculation section detects the month January. Since in this illustrated embodiment the data is December of 1981, the day following the 31st is January 1st so that both a month and year carry are performed in the respective calculation circuits. The date calculation circuit 88 and the day of the week calculation circuit 90 are incremented in the same way so that the month calculation circuit 86 performs a carry operation. The 107 days necessary to bring the data in the third counter circuit 32′ to April 1st which will be in agreement with the month data in the register 36 are added to the date and day of the week data of the circuit 32′. The controller 28 bring the content of the circuit 32′ to Thursday, Apr. 1, 1982. The comparator 34 compares the month data and issues a month coincidence signal operative to shift the calculation section to the date item. Thus the day of the week circuit 90 is incremented until the date calculation circuit 88 is brought into agreement. The comparator 34 generates a date coincidence signal when the content of the circuit 32′ attains a date of Monday, Apr. 26, 1982. Although this signal has brought the calculation circuits to the point for a retrieval of the day of the week item, the register 36 has not been input with a value representative of the day of the week data since this is the item sought. As all of the other data in the register 36 and the circuit 32′ are in agreement, the comparator 34 sends the coincidence signal to the controller 28 which then provides a signal to the gate 94 to halt the calculations and controls the change-over device 18 (see FIG. 1) to display the content of the circuit 32′; the content thus appears on display device 102 as shown in FIG. 17(*b*).

Another example will now be described with reference to FIG. 18 in which the register 36 is input with data representative of Monday, April, 1982; the date data is "00" since this is the indefinite information which is sought. The register 36 is input with year and month data in the same manner as previously described. For the date data, "00" is established by depressing the switch 100 after the date item has been selected by the switch 98. For the day of the week data, the switch 100 is depressed after the day of the week item has been selected by the switch 98, whereby Monday is displayed by display device 102 as shown in FIG. 18(*a*). After these settings have been made, the switch 96 is returned to its normal position and the switch 98 is then depressed to start the calculations.

These calculations begin, as stated previously, in the year calculation circuit 82. This circuit along with the day of the week calculation circuit 90 is incremented until the comparator 34 applies a coincidence signal to the controller 28. Whenever the leap year detector 84 detects a leap year, the day of the week calculation circuit 90 is further incremented by one count. The content of the circuit 32' thus is brought to a calendar date of Tuesday, Dec. 15, 1981 and the controller 28, due to the coincidence signal for the year calculation circuit, selects the months item from among the calculation sections. Thus, date calculation circuit 88 is incremented until month calculation circuit 86 is brought into agreement with the April 1st data of the register 36. The 107 days required to accomplish this are added to date calculation circuit 88 and the day of the week calculator circuit 90 which retrieves the day Tuesday. During the course of these calculations the year calculation circuit 82 undergoes a 1-year carry and the content of the circuit 32' thus becomes Thursday, Apr. 1, 1982. A coincidence signal is applied to the controller 28 whereby the calculation circuits are ready to retrieve the date item. However, since the date data of the register 36 has been set to 00 the date calculation circuit 88 is in agreement so that the comparator 34 delivers a coincidence signal to the controller 28 which selects the day of the week item from the calculation circuits. Thus, the day of the week calculation circuit 90 is incremented until it is brought into agreement with the day of the week data in the register 36; the four days required to accomplish this are applied incrementally to the date calculation circuit 88 thus bringing its content to Monday, Apr. 5, 1982. The comparator 34 delivers to the controller 28 a coincidence signal representative of all of this data whereby the controller controls the circuits 32 to halt its calculations and controls the changeover device 18 to display the content of the circuit 32'; the content thus appears on the display device 102 as shown in FIG. 18(*b*). If the switch 98 is now depressed, this removes the control signal which halted the calculation in the day of the week calculation circuit 90. Accordingly, the day of the week calculation resumes until there is once again an agreement with day of the week data in the register 36; this means that 7 more days will be applied bringing the content of the circuit 32' to a calendar date of Monday, Apr. 12, 1982, as shown in FIG. 18(*c*). Thus, each time the switch 98 is depressed the counter circuit 32' begins to calculate so that Its content is successively shifted at one-week intervals to calendar dates of Monday, Apr. 19, 1982 and Monday, Apr. 26, 1982, as shown in FIGS. 18 (*d*) and (*e*).

As still another example, FIG. 19(*a*) shows a case in which the register 36 is input with information representative of Apr. 26, 1955; here, the day of the week for this calendar date is desired. After the switch 96 is returned to is normal position, the switch 98 is depressed in order to instruct the controller to begin calculations. Accordingly, the comparator 34 compares the year data in the register 36 and circuit 32'. Since the input data "55" is smaller than the reference data "75", controller 28 provides a control signal to the year calculation circuit 82 and day of the week calculation circuit 90 of the circuit 32' to simultaneously perform a subtraction operation. Using the high speed calculation signal as controlled by the gate 94, this subtraction operation continues until the comparator 34 generates a coincidence signal. Since this comparator as previously described applies a coincidence signal to the controller when the difference between the value of the year input data and the data in the year calculation circuit 82 attains a value of 1, "21" is substracted incrementally from the data in year calculation circuit 82 and a coincidence signal is generated when this data is reduced to a value of "54". In addition to year calculation circuit 82, the data in day of the week calculation circuit 90 is also simultaneously reduced by "21" in an decremental manner, and the leap year detector 84 detects 5 leap years "72", "68", "64", "60" and "56" during the year calculation such that the data in day of the week calculation circuit 90 is reduced by one count each time a leap year is so detected. The content of the circuit 32 is thus brought to Wednesday, Dec. 15, 1954.

In the next set of calculations, the controlled 28 provides a second control signal to the date calculation circuit 88 and the days of the week calculation circuit 90 which are consequently incremented in response to the high speed signal gated through the gate 94 until the content of the month calculation circuit 86 is brought into agreement with the register 36. However, since the year calculation stopped at the year "54" which is one year prior to the year data in the register 36, an addition operation is performed, as was previously the case. Thus the 107 days which are necessary to bring the year and month data into agreement with in the input data are applied incrementally to the date calculation circuit 88 and the day of the week calculation circuit 90, thereby bringing the content of the circuit 32' to Friday, Apr. 1, 1955. In the same way, the 25 days necessary to bring the date calculation circuit 88 into agreement are added to both this circuit and the day of the week calculation circuit 90; in other words, the day of the week circuit and date circuit are incremented by 3 weeks and 4 days, bringing the content of the circuit 32' to Friday, Apr. 26, 1955. Since the day of the week calculation circuit 90 is always in agreement with the day of the week input day which has been set to "0", the comparator 34 delivers a signal representative of complete coincidence to the controller 28 which inputs the gate 94 to halt calculations and causes a display of the content of the circuit 32' which appears as a calendar date of Tuesday, Apr. 26, 1955 as shown by FIG. 19(*b*).

It is apparent from the foregoing that with a reference date of Monday, Dec. 15, 1975, any data which is established in order to retrieve an indefinite item is data having a year date restricted to the 1900's, i.e., "0" (1900) to "99" (1999); this follows from the fact that the year display station of display device 102 is composed of only two digits. However, if in actuality the reference data source 30 is capable of being set to data representative of any year, month, date, day of the week and the number of years that have passed since the last leap year, it is possible to retrieve data relating to calendar information of 100 years or less which includes the desired year item as displayed by two digits.

In this embodiment it is possible to set the register 36 year month, date or day of the week data which does not actually exist, for example to a date of February 29 in a year which is not a leap year by the input device 26. In this case there can be no agreement in data and as a result calculations continue without an instruction to cease. It is therefore advantageous to provide for an error display which is actuated whenever a certain predetermined calendar date is detected twice during the calculations for the date item. It is also permissible to provide for means which halt calculations and display an error signal upon detection of calculations which continue beyond a 31st day during the date calculation mode, the longest possible duration of any month.

It will be appreciated that the calendar function as herein described consumes much less time in calculating a year than is the case with the first embodiment; hence, the amount of time required to detect and retrieve an indefinite item can be greatly reduced even if the year data in the reference data source and the input year data are widely separated in time. Moreover, after the year calculations are completed the method as previously described may be followed in which the data and day of the week are incremented so as to successively bring the month, date and day of the week into agreement with the register. Alternatively, however, the month calculation section can be negatively or positively incremented one count at a time as was the year calculation circuit, and the day of the week calculation circuit operated on by adding or subtracting "3" for 31-day months, "2" for 30-day months, "1" for a 29-day February, and "0" for a 28-day February.

Although a method was described in which the year and day of year, the week calculation circuits were operated on by adding or subtracting "1", with an additional count being added or subtracted each time a leap year is detected thereby eventually bringing the year data into agreement, it is equally permissible to calculate the years first and then calculate the day of the week based upon this result.

Further, since a subtraction operation is not required when the reference data is smaller than the desired data, a calculation instruction which calls for only an addition operation will suffice if the reference data is set to the lower limit of the input data which includes the desired indefinite item. For example, the reference data will be set to Saturday, Jan. 1, 2000 for data relating to a calendar for the 21st century which begins in the year 2000. Moreover, as it is sufficient for the comparator to produce a coincidence signal when the input data and calculated data are in agreement, without requiring that the comparator be set to a predetermined value, the circuits associated with the calculation sections and the comparator can be greatly simplified if only addition operations are demanded.

While the present invention has been shown and described with reference to particular embodiments, it should be noted that various other changes or modifications may be made without departing from the scope of the present invention.

What is claimed is:

1. An electronic timepiece having an oscillator circuit to provide a relatively high frequency signal, a frequency divider to divide down the relatively high frequency signal to provide a low frequency signal, first counter circuit means responsive to the low frequency signal to provide time information signals, second counter circuit means responsive to the time information signals to provide calendar information signals, and a driver circuit responsive to the time and calendar information signals to provide drive signals to cause a display device to display time and calendar data, comprising:

means for presetting reference data indicative of an existing year, month, date and day of the week and including a plurality of counter means capable of counting leap years, years, months, dates, and days of the week at a high speed from a preset reference data;

means for storing calendar data indicative of a desired year, month, date, and day of the week to be determined;

means for comparing the content of said presetting means and the content of said storing means and generatng a coincidence signal when the contents are in agreement; and means for halting counting operation of said counter means in response to said coincidence signal to cause said display device to display the contents of said counter means.

2. An electronic timepiece comprising:

means for generating a relatively high frequency signal;

means for dividing the relatively high frequency signal to provide a low frequency signal;

means for generating time information signals in response to the low frequency signal;

means for presetting reference data indicative of an existing leap year, year, month, date and day of the week and counting leap years, years, months, dates and days of the week at a high speed with the reference data serving as starting point;

means for storing a desired year, month, date and days of the week to be determined;

means for comparing the content of the presetting means and the content of the storing means and generating a coincidence signal when the contents are in agreement;

means for halting counting operation of the presetting means in response to the coincidence signal and generating an output signal in response thereto;

means for generating drive signals in response to the time information signals;

means for displaying time information in response to the drive signals; and means for passing an output from the presetting means to the drive signal generating means in response to the output signal from the halting means to cause the content of the presetting means to be displayed by the display means.

3. An electronic timepiece according to claim 2, further comprising means for generating calendar information signal indicative of a leap year, year, month, date, and day of the week in response to the time information signal.

4. An electronic timepiece according to claim 3, further comprising means for inputting input signals to the time information signal generating means and the calendar information signal generating means.

5. An electronic timepiece according to claim 3, further comprising a source of the reference data coupled to the presetting means.

6. An electronic timepiece according to claim 5, in which the reference data is set in the reference data source by means of an external control member.

7. An electronic timepiece according to claim 5, in which the presetting means comprises gate means for selectively passing a high frequency signal therethrough, a dates counter connected to an output of the gate means to count dates at a high speed in response to the high frequency signal, a days of the week counter connected to the output of the gate means in parallel to the dates counter to count days of the week at a high speed in response to the high frequency signal, a months counter connected to an output of the dates counter to count months, and a years counter connected to an output of the months counter to count years, outputs of the dates counter, months counter, years counter and days of the week counter being applied to the comparing means.

8. An electronic timepiece according to claim 7, in which the presetting means further comprises a leap year counter connected to the output of the months counter, and a carry control unit connected to an output of the leap year counter to apply a carry signal to the dates counter to cause the dates counter to automatically perform a February correction.

9. An electronic timepiece according to claim 8, in which all of the counters of the presetting means have preset terminals coupled to the reference data source.

10. An electronic timepiece according to claim 9, in which all of the counters of the presetting means have control terminals connected to the halting means and are responsive to a control signal generated thereby to preset the reference data in all of the counters.

11. An electronic timepiece according to claim 10, in which the storing means comprises a dates counter, a months counter, a years counter, and a days of the week counter, and a plurality of gate means each having a control terminal responsive to the control signal from the halting means, an input terminal adapted to receive an input signal, and an output terminal connected to each of the counters to set the optional year, month, date and days of the week in response to the input signal applied to each of the counters.

12. An electronic timepiece comprising:

means for generating a relatively high frequency signal;

means for dividing the relatively high frequency signal to provide a low frequency signal;

means for generating time information signals in response to the low frequency signal;

means for generating calendar information signal indicative of a date, day of the week, month and year in response to the time information signals;

means for changing over the calender information signal generating means to a calendar function mode from its normal timekeeping mode for thereby causing the calendar information signal generating means to count at a high speed in response to a high frequency signal from the dividing means;

means for storing a desired year, month, date and day of the week to be determined;

means for comparing the content of the calendar information signal generating means and the content of the storing means to generate a coincidence signal when the contents are in agreement; and means for displaying the content of the calendar information signal generating means in response to the coincidence signal.

13. An electronic timepiece according to claim 12, in which said changing over means comprises a gate circuit having a first input coupled to an output of the time information signal generating means, a second input coupled to an intermediate stage of the dividing means to receive a high frequency signal therefrom, and a control terminal adapted to receive a control signal to pass the high frequency signal through the gate circuit, and control means for generating the control signal, the calendar information signal generating means being responsive to the control signal changed over to its calendar function in which the calendar information signal generating means counts the years, months, dates and days of the week at the high speed in response to the high frequency signal.

14. An electronic timepiece according to claim 13, further comprising a latch circuit for storing the content of the calendar information signal generating means before it is changed over to its calendar function and inputting stored data into the calendar information signal generating means when it is changed over to its normal timekeeping mode.

15. An electronic timepiece comprising:

means for generating a relatively high frequency signal;

means for dividing the relatively high frequency signal to provide a low frequency signal;

means for generating a time information signal in response to the low frequency signal;

a source of reference data indicative of an existing year, month, date and day of the week;

counter circuit means including a gate circuit selectively passing a high frequency signal therethrough from the dividing means, a dates counter coupled to an output of the gate circuit, a days of week counter coupled to the output of the gate circuit, a months counter connected to an output of the dates counter, and a years counter coupled to the output of the gate circuit, all of the counter circuits having preset terminals connected to the reference data source and presetting the date, day of the week, month and year of the reference data therein, respectively;

register means for storing a desired year, month, date and day of the week to be determined;

means for comparing the content of the counter circuit means and the content of the register means and generating an output signal when a difference between year data in the counter circuit means and year data in the register means reaches a predetermined value, and a coincidence signal when the content of the counter circuit means and the content of the register means are in agreement;

control means for generating a first control signal to open the gate circuit of the counter circuit means to pass the high frequency signal to the year counter to cause the same to count years at a high speed until the output signal is generated by the comparing means after which the month, date and day of the week counters start counting, and a second control signal in response to the coincidence signal to halt counting operation of the counter circuit means; and means for displaying the content of the counter circuit means in response to the second control signal.

* * * * *